US010738449B2

(12) United States Patent
Gu

(10) Patent No.: US 10,738,449 B2
(45) Date of Patent: Aug. 11, 2020

(54) HYDRAULIC ENERGY STORAGE MECHANISM AND PEDESTAL PAN TOILET

(71) Applicant: Guoqing Gu, Shanghai (CN)

(72) Inventor: Guoqing Gu, Shanghai (CN)

( * ) Notice: Subject to any disclaimer, the term of this patent is extended or adjusted under 35 U.S.C. 154(b) by 159 days.

(21) Appl. No.: 15/770,509

(22) PCT Filed: Oct. 19, 2016

(86) PCT No.: PCT/CN2016/102543

§ 371 (c)(1),
(2) Date: Apr. 24, 2018

(87) PCT Pub. No.: WO2017/071507

PCT Pub. Date: May 4, 2017

(65) Prior Publication Data

US 2018/0223513 A1 Aug. 9, 2018

(30) Foreign Application Priority Data

Oct. 27, 2015 (CN) ..... 2015 1 0703094
Dec. 31, 2015 (CN) ..... 2015 1 1013727
Aug. 2, 2016 (CN) ..... 2016 1 0626647

(51) Int. Cl.
*E03D 3/04* (2006.01)
*E03F 1/00* (2006.01)
(Continued)

(52) U.S. Cl.
CPC ..... *E03D 3/04* (2013.01); *E03D 5/012* (2013.01); *E03D 5/024* (2013.01); *E03D 9/16* (2013.01); *E03F 1/006* (2013.01)

(58) Field of Classification Search
CPC .. E03D 3/02; E03D 3/04; E03D 5/012; E03D 5/024; F15B 15/261
See application file for complete search history.

(56) References Cited

U.S. PATENT DOCUMENTS 295,010 A * 3/1884 Howard ..... E03D 5/012 4/435
882,740 A * 3/1908 Brooks ..... E03D 3/04 251/36

(Continued)

FOREIGN PATENT DOCUMENTS

DE 10118549 A1 * 1/2003 ..... E03D 5/012
FR 2250358 A5 * 5/1975 ..... E03D 5/012

(Continued)

*Primary Examiner* — Michael Leslie
*Assistant Examiner* — Matthew Wiblin
(74) *Attorney, Agent, or Firm* — Gearhart Law LLC

(57) ABSTRACT

The present invention discloses a hydraulic energy storage mechanism, including a cylinder block, a cylinder body, a piston, a support, and a latch bolt component. In the present invention, a cylinder body, a piston, and a support structure being provided with a power slide block is used, and the tap water pressure is applied to push the piston to compress a spring and converted into elastic potential energy; the power slide block is driven by releasing the elastic potential energy to operate a suction drainage device of a water closet. The present invention has advantages of a small volume, large acting force, a simple structure, and reliable working, and effectively improves sewage drainage efficiency of the water closet.

14 Claims, 4 Drawing Sheets

(51) Int. Cl.

| | |
|---|---|
| ***E03D 9/16*** | (2006.01) |
| ***E03D 5/012*** | (2006.01) |
| ***E03D 5/02*** | (2006.01) |

(56) References Cited

U.S. PATENT DOCUMENTS

| | | | | | |
|---|---|---|---|---|---|
| 1,123,477 | A * | 1/1915 | Brooks | E03D 3/04 | 251/36 |
| 1,273,140 | A * | 7/1918 | Brooks | E03D 3/04 | 251/36 |
| 2,768,610 | A * | 10/1956 | Lieser | F15B 15/261 | 91/418 |
| 3,217,610 | A * | 11/1965 | Roskin | F15B 15/261 | 92/25 |
| 4,232,409 | A * | 11/1980 | Van Pham | E03D 3/00 | 4/362 |
| 5,228,147 | A * | 7/1993 | Fominaya Agullo | E03D 5/024 | 4/391 |
| 6,279,176 | B1 * | 8/2001 | Aviles | E03D 1/286 | 4/354 |
| 2012/0124729 | A1 * | 5/2012 | Gu | E03D 5/012 | 4/431 |

FOREIGN PATENT DOCUMENTS

| | | | | |
|---|---|---|---|---|
| FR | 2435566 | A1 * | 4/1980 | E03D 5/012 |
| WO | WO-2004029373 | A1 * | 4/2004 | A47K 13/30 |

* cited by examiner

HYDRAULIC ENERGY STORAGE MECHANISM AND PEDESTAL PAN TOILET

CLAIM OF PRIORITY

This application claims priority to PCT/CN2016/102543 filed on Oct. 19, 2016 which claims priority to CN201510703094.3 filed on Oct. 27, 2015 and CN201610626647.4 filed Aug. 2, 2016 and CN201511013727.4 filed on Dec. 31, 2015 the contents of all of which are herein fully incorporated by reference in their entirety.

FIELD OF THE EMBODIMENTS

The present invention relates to a water closet in the technical field of sanitary wares, the water closet is provided with a drive mechanism for applying tap water pressure to store and release energy, and used for lifting suction and sewage drainage efficiency of a suction drainage device of the water closet; and the present invention particularly relates to a hydraulic energy storage mechanism of the water closet.

BACKGROUND OF THE EMBODIMENTS

To save water and improve sewage drainage effects of the water closet, a patent with an application number of 201010126268.1 disclosed a "buoyancy control mechanism of a suction drainage device of a water closet"; the mechanism is connected to the suction drainage device, and drives suction and sewage drainage by the buoyancy. Existing problems are that a buoyancy tank has a large volume and a small acting force; because of the size of the water closet, the installation position and operable space are limited, and the volume of the buoyancy tank needs to be increased for improving the suction force, thereby limiting technical promotion and application of the "buoyancy control mechanism of a suction drainage device of a water closet".

SUMMARY OF THE EMBODIMENTS

The present invention is aimed at providing a hydraulic energy storage mechanism with respect to defects of the prior art. In the present invention, a cylinder body, a piston, and a support structure being provided with a power slide block is used, and the tap water pressure is applied to push the piston to compress a spring and converted into elastic potential energy; the power slide block is driven by releasing the elastic potential energy to operate a suction drainage device of a water closet. The present invention has advantages of a small volume, large acting force, a simple structure, and reliable working, and effectively improves sewage drainage efficiency of the water closet.

The specific technical solutions for implementing the objective of the present invention are:

A hydraulic energy storage mechanism, and the hydraulic energy storage mechanism includes:

a cylinder block provided with a water inlet and a water outlet, and axially provided with a seal rod, the axle center of the seal rod being provided with a first piston rod hole;

a piston cylinder axially provided with a cylinder body and a piston guide cylinder, and axially connected to one end of the cylinder block;

a piston provided with a piston rod, one end of the piston being provided with a pressing block and the other end being provided with a guiding cylinder, and the piston being provided in the piston cylinder;

a first support provided with a power slide block and a slide block lock base, and axially connected to the other end of the cylinder block, the slide block lock base being provided thereon with a latch bolt hinge base and a spring seat, the power slide block being provided thereon with a spring hole, a lock slot, and a second piston rod hole; and a latch bolt component provided in the slide block lock base of the support.

Preferably, the latch bolt component including a latch bolt, a wedge, and a third spring; the wedge is a strip body with a slope provided on one end and a lock catch provided on the other end; the latch bolt is hinged on a latch bolt hinge base of the slide block lock base, the wedge is provided in the slide block lock base, and the third spring is provided between the wedge and the spring seat of the slide block lock base.

Preferably, one end of the piston rod provided with the pressing block on the piston passes through the first piston rod hole of the seal rod and the second piston rod hole of the power slide block, and one end provided with the guiding cylinder is sleeved to the seal rod of the cylinder block.

Preferably, a first spring is disposed between the guiding cylinder of the piston and the piston guide cylinder of the piston cylinder.

Preferably, a second spring is disposed between one end surface of the first piston rod hole of the cylinder block and the spring hole of the power slide block.

A hydraulic energy storage mechanism includes a piston cylinder and a control device;

the piston cylinder is provided thereon with a water inlet and a water outlet; the piston cylinder is provided therein with a piston connected to a piston rod; a first spring is provided between the piston or a part synchronously moving with the piston and the piston cylinder;

the control section includes a first support, a power slide block, and a locking and unlocking mechanism, and the first support is connected to the piston cylinder; the power slide block is disposed in the first support, and a second spring is provided between the power slide block and the first support; the power slide block can move along the support; a device for closing the water inlet is disposed on a travel upper limit position of the power slide block, and a device for opening the water inlet and a device for closing the water outlet are disposed on a travel lower limit position; one end of the piston rod movably pass through the piston cylinder, the support, and the power slide block, and then is connected to a pressing block; the locking and unlocking structure is used for locking and unlocking between the power slide block and the first support;

the piston cylinder drains away water; the first spring pushes the piston and the piston rod to move downwards; the piston rod moves downwards to the travel lower limit position of the piston rod and triggers the locking and unlocking mechanism to implement unlocking between the power slide block and the first support; under a action of a second spring, the power slide block moves downwards to the travel lower limit position to trigger a device disposed on the travel lower limit position of the power slide block and used for closing the water outlet, and a device for opening the water inlet; the piston cylinder supplies water; the piston drives the piston rod to move upwards and compress the first spring; the piston rod drives, by means of the pressing block, the power slide block to move upwards and compress the second spring; the power slide block moves upwards to the travel upper limit position, triggers the device provided for closing the water inlet, and stops supplying water; at this time, the power slide block and the first support are in a locking state.

Preferably, the piston cylinder including a cylinder body, a piston guide cylinder, and a cylinder block; two axial ends of the cylinder body are respectively connected to the piston guide cylinder and the cylinder block; the piston is disposed in the cylinder body, and an upper end of the piston rod stretches into the piston guide cylinder; the cylinder block is connected with the cylinder body, the water inlet and the water outlet are disposed on the cylinder block, the cylinder block is connected to the support.

Preferably, a seal rod and a guiding cylinder are axially disposed in the piston cylinder, a first piston rod hole is disposed at the center of the seal rod, the seal rod is axially fixed in the piston cylinder, and one end of the piston rod passes through the first piston rod hole of the seal rod; the guiding cylinder is fixedly sleeved on one end of the piston rod and stretches into the piston guide cylinder together; the first spring is sleeved on the guiding cylinder, and the upper end of the first spring abuts against the top of the piston guide cylinder; one end of the guiding cylinder is fixedly connected to the piston rod, and the other end is sleeved on the seal rod; the guiding cylinder and the piston rod axially move relative to the seal rod; the piston is fixedly sleeved on the guiding cylinder.

Preferably, one end of the first support is axially connected to one end of the piston cylinder; the power slide block is disposed in the first support; one end surface of the power slide block facing the piston cylinder is disposed with a spring hole; one end of the second spring is disposed in the spring hole, and the other end abuts against the end part of the support.

Preferably, the locking and unlocking mechanism includes:

a latch bolt, wherein a side wall of the first support is provided thereon with an installation through-hole, a latch bolt hinge base is disposed in the installation through-hole, and the latch bolt is hinged on the latch bolt hinge base in the installation through-hole; the outer side wall of the power slide block is disposed with a lock slot which matched to the latch bolt; and a wedge, wherein a slide block lock base is formed on a position, corresponding to the installation through-hole, of the outside of the side wall of the first support; the wedge is disposed in the slide block lock base and can move along the slide block lock base; a spring seat is disposed in the slide block lock base, the third spring is disposed between the wedge and the spring seat; a slope is disposed on a surface of one end of the wedge opposite to the latch bolt, and a lock catch stretching into the first support is disposed on the other end;

the slope end on the upper end of the wedge abuts against the latch bolt, so that the latch bolt is clamped into the lock slot for locking; the pressing block moves to the lock catch to push the lock catch so as to enable the wedge to move, and the wedge moves to enable the latch bolt to move along the slope, so that the latch bolt is departed from the lock slot for unlocking.

A hydraulic energy storage mechanism is featured by, including a hydraulic energy storage mechanism in any one of the foregoing claims, and a relief valve; wherein a relief water outlet is further disposed on the piston cylinder, and the relief valve is disposed on the relief water outlet; opening or closing of the relief valve is implemented through triggering by the piston or a part synchronously moving with the piston;

during a water supplying process of the piston cylinder, the power slide block moves upwards; before being locking, the piston or the part synchronously moving with the piston triggers to open the relief valve; the power slide block continues moving upwards, moves to the travel upper limit position of the power slide block, and triggers a device which is disposed on a travel upper limit position of the power slide block and used for closing a water inlet, so as to stop supplying water; some water in the piston cylinder is discharged through a relief drainage tube, and the power slide block is locked at this time; the first spring continues pushing the piston, the piston rod, and the pressing block to separate from the power slide block; meanwhile, the relief valve is gradually reset to closed, and the piston, the piston rod, and the pressing block stop moving downwards;

during a drainage process of the piston cylinder, a first elastic structure pushes the piston and the piston rod to move downwards; the piston rod moves downwards to the travel lower limit position of the piston rod and triggers the locking and unlocking mechanism to unlock the power slide block; under a action of a second elastic structure, the power slide block moves downwards to the travel lower limit position to trigger a device which is disposed on the travel lower limit position of the power slide block and used for closing the water outlet, and a device for opening the water inlet.

Preferably, the piston controls the relief valve to open and close by using a triggering mechanism. The triggering mechanism includes a second support, a lever, and a bracket; the second support is fixed on the top of the outside of the piston cylinder; the lever can be rotatably installed on the second support through a support axle; one end of the lever is connected to the bracket, a lower end of the bracket stretches into the piston cylinder, and the other end of the lever is connected to the relief valve; the piston moves upwards to contact the bracket and jacks up the bracket; the lever rotates, and the other end of the lever is pressed downwards to open the relief valve.

Preferably, the relief valve includes:

a valve seat, wherein a drainage chamber is disposed in the valve seat, a water outlet of the relief valve and a water inlet of the relief valve are disposed on the drainage chamber, and the water inlet of the relief valve is connected with the relief water outlet;

a valve core is blocked at a position of the drainage chamber connected with the water inlet of the relief valve;

a valve core axle, the lower end of which stretching into the valve seat and being connected to the valve core; and a valve cover fixedly connected to an upper end of the valve core axle, wherein a fourth spring is provided between the valve cover and the valve seat; and the valve cover is further connected to the other end of the lever by using an adjustment screw.

The present invention further provides a water closet, using the hydraulic energy storage mechanism of any one of the claims, the hydraulic energy storage mechanism is used to open or close a suction drainage device of the water closet.

Because of the use of the foregoing technical solutions, as compared with the prior art, the present invention has the following advantages and positive effects:

The hydraulic energy storage mechanism provided by the present invention, the water pressure generated by supplying water by the piston cylinder is applied to drive the piston and compress the first elastic structure and converted into elastic potential energy for energy storage; the power slide block is driven by releasing the elastic potential energy during drainage; when the hydraulic energy storage mechanism is applied to the water closet, movement of the power slide block is used to operate the suction drainage device of the water closet. As compared with the buoyancy control mechanism in the prior art, the size of the buoyance tank is not required to be considered for the hydraulic energy storage mechanism. The hydraulic energy storage mechanism in the present invention has advantages of a small volume, large acting force, a simple structure, secure, light and convenient, and reliable working, and effectively improves sewage drainage efficiency of the water closet. The overall structure is more miniature, so as to facilitate expanding application scope.

In addition, a relief valve is further disposed on the hydraulic energy storage mechanism which is provided in the present invention, so that after a water supplying process of the piston cylinder is completed, the pressing block is not under the action of the second elastic structure, the piston rod is not under the action of the second elastic structure, and the piston is not under the action of the second elastic structure, so as to reduce the pressure in the piston cylinder chamber, and the drainage valve can be easily opened. The operations are more secure and convenient.

BRIEF DESCRIPTION OF THE DRAWINGS

The foregoing and other features and advantages of the present invention can be understood more clearly with reference to the accompany drawings and through the following detailed descriptions.

DESCRIPTION OF THE PREFERRED EMBODIMENTS

With reference to the accompany drawings of the embodiments of the present invention, the present invention is described in details in the following. However, the present invention can be implemented in many different forms, and should not be explained to be limited by the embodiments proposed herein. On the contrary, these embodiments are proposed to reach fully and complete disclosure, and to enable a person skilled in the art to completely know the scope of the present invention. In these accompany drawings, for charity, the size and the relative size of the layer and the region can be amplified.

Embodiment 1

Figure 1:
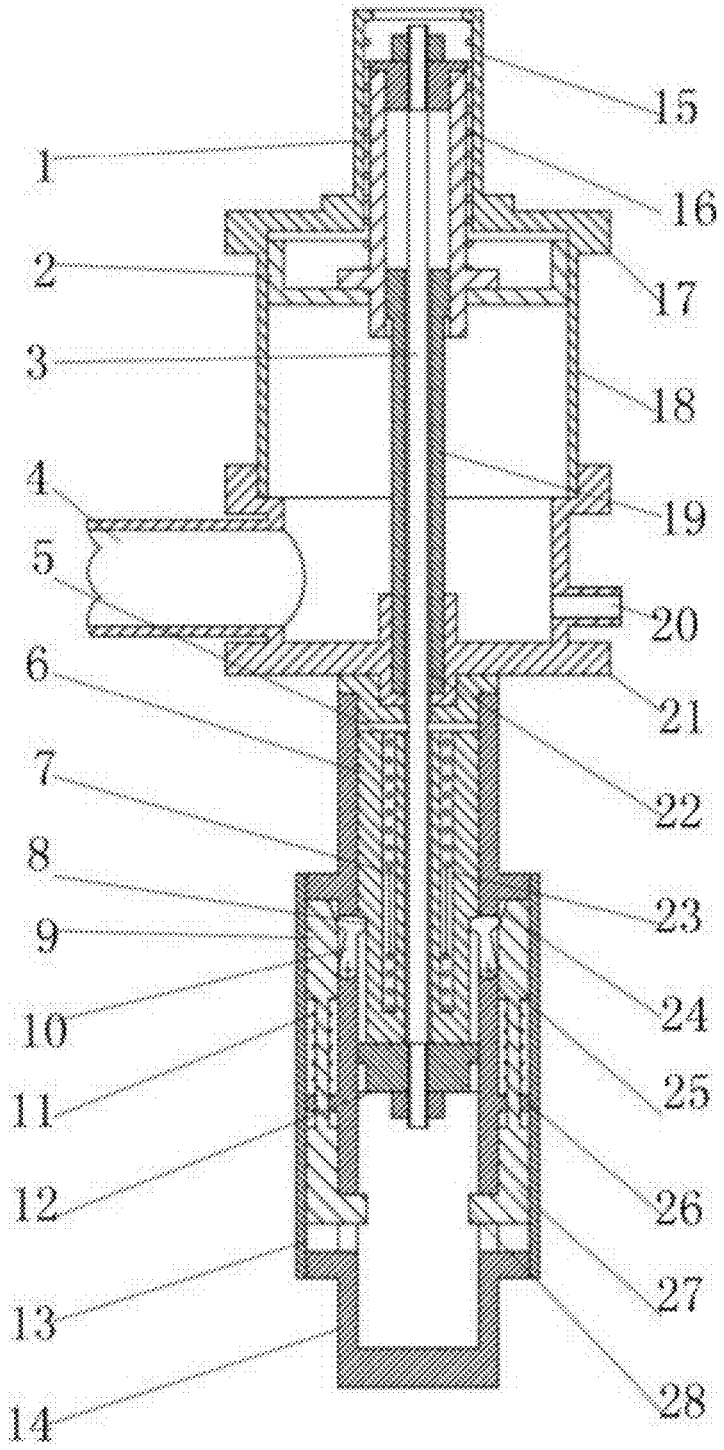
FIG. 1 shows a schematic structural diagram for embodiment 1 and embodiment 2 of the present invention.

Referring to FIG. 1, the present invention includes:

a cylinder block 21 provided with a water inlet 20 and a water outlet 4, and axially provided with a seal rod 19, the axle center of the seal rod 19 being provided with a first piston rod hole 22;

a piston cylinder 17 axially provided with a cylinder body 18 and a piston guide cylinder 15, and axially connected to one end of the cylinder block 21;

a piston 2 provided with a piston rod 3, one end of the piston being provided with a pressing block 12 and the other end being provided with a guiding cylinder 1, and the piston 2 being provided in the piston cylinder 17;

a first support 14 provided with a power slide block 6 and a slide block lock base 13, and axially connected to the other end of the cylinder block 21, the slide block lock base 13 being provided thereon with a latch bolt hinge base 25 and a spring seat 26, the power slide block 6 being provided thereon with a spring hole 23, a lock slot 8, and a second piston rod hole 7; and a latch bolt component 9 provided on the first support 14 and in the slide block lock base 13.

The latch bolt component 9 including a latch bolt 10, a wedge 27, and a third spring 11; the wedge 27 is a strip body with a slope 24 provided on one end and a lock catch 28 provided on the other end; the latch bolt 10 is hinged to a latch bolt hinge base 25 of the slide block lock base 13, the wedge 27 is provided in the slide block lock base 13, and the third spring 11 is provided between the wedge 27 and the spring seat 26 of the slide block lock base 13.

One end of the piston rod 3 provided with the pressing block 12 on the piston 2 passes through the first piston rod hole 22 of the seal rod 19 and the second piston rod hole 7 of the power slide block 6, and one end provided with the guiding cylinder 1 is sleeved to the seal rod 19 of the cylinder block 21.

A first spring 16 is disposed between the guiding cylinder 1 of the piston 2 and the piston guide cylinder 15 of the piston cylinder 17.

A second spring 5 is disposed between one end surface of the first piston rod hole 22 of the cylinder block 21 and the spring hole 23 of the power slide block 6.

Figure 2:
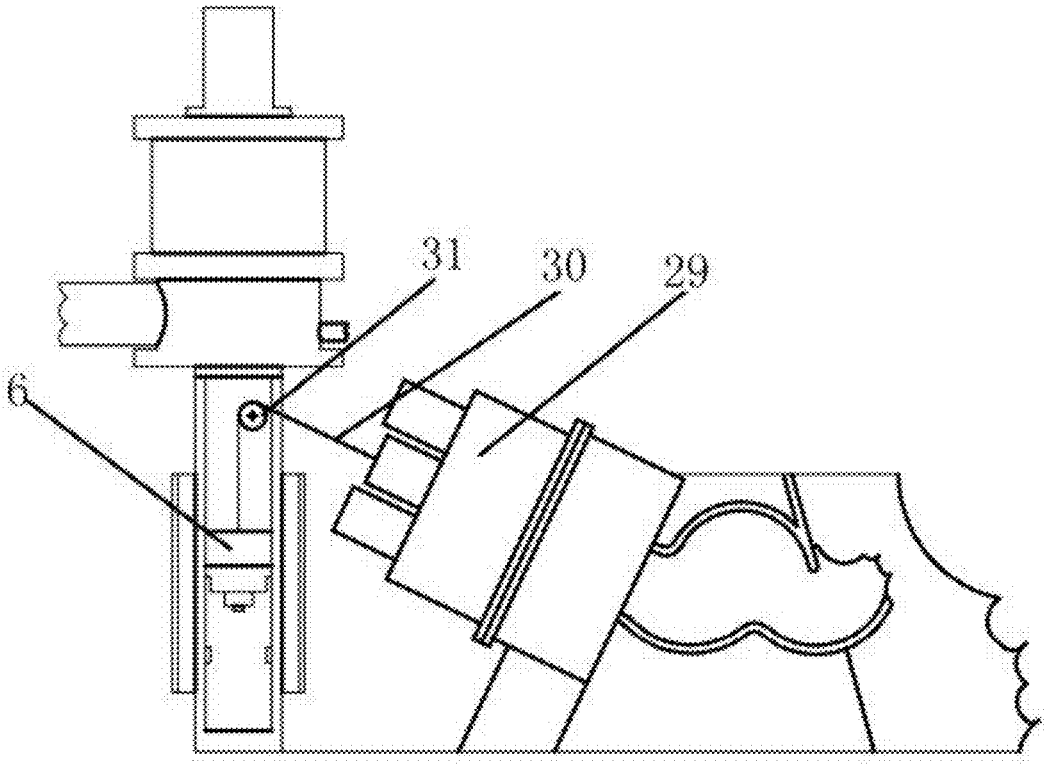
FIG. 2 shows a schematic diagram for connection of a hydraulic energy storage mechanism and a suction drainage device provided in embodiment 1 and embodiment 2 of the present invention.

The specific embodiments are as follows:

Referring to FIG. 1 and FIG. 2, the present invention is connected to a suction drainage device 29 of the water closet for use, and a draw cord 30 of the suction drainage device 29 of the water closet is connected to the power slide block 6 of the present invention via a pulley 31. A drainage valve is connected to the water outlet 4 of the present invention, a water inlet 20 is connected to a water inlet valve, the drainage valve is provided with a drainage button, and a water inlet valve switch and a close control rod of the drainage valve are installed on a limiting position of the travel of the power slide block 6 of the first support 14. The working process of the present invention is as follows:

Washing process: referring to FIG. 1 and FIG. 2, the drainage button of the water closet is pressed manually; the drainage valve of the water outlet 4 is opened, and the water in the piston cylinder 17 is discharged from the water outlet 4; with the water drainage in the piston cylinder 17 is discharged, the acting force of the water on the piston 2 disappears; under the action of a first spring 16, the piston 2, the piston rod 3, and the pressing block 12 moves downwards in the piston cylinder 17, the first piston rod hole 22 of the seal rod 19, and the second piston rod hole 7 of the power slide block 6; at this time, the power slide block 6 is static, and the pressing block 12 starts to disengaging from the power slide block 6; when the pressing block 12 contacts the lock catch 28 of the wedge 27, the wedge 27 overcomes the resistance of the third spring 11 to move downwards in the slide block lock base 13, until the slope 24 of the wedge 27 reaches the position of the latch bolt 10; at this time, the piston 2, the piston rod 3, the pressing block 12, and the wedge 27 reach limiting positions; the latch bolt 10 hinged to the latch bolt hinge base 25 is disengaging from the lock slot 8 of the power slide block 6. Under the action of the second spring 5, the power slide block 6 slides downwards in the first support 14; at this time, the power slide block 6 drives the draw cord 30 of the suction drainage device 29 of the water closet to start working. Because the switch of the water inlet valve and the close control rod of the drainage valve are installed on the travel limiting positions of the power slide block 6, when the power slide block 6 slides downwards to the limiting position, the suction drainage device 29 completes the suction drainage work of the water closet, meanwhile, the power slide block 6 contacts the switch of the water inlet valve, and the close control rod of the drainage valve closes the drainage valve and opens the water inlet valve; the tap water supplies water to the piston cylinder 17 via the water inlet 20 of the cylinder block 21.

Reset process: referring to FIG. 1 and FIG. 2, with the opening of the water inlet valve, the tap water supplies water to the piston cylinder 17 via the water inlet 20 of the cylinder block 21; the water acting on the surface of the piston 2 exerts pressure to the piston 2 and overcomes the resistance of the first spring 16; the piston 2, the piston rod 3, and the pressing block 12 moves upwards in the piston cylinder 17 and overcomes the resistance of the second spring 5; the pressing block 12 drives the power slide block 6 to slide upwards in the first support 14; when the lock slot 8 of the power slide block 6 slides to a reset position of the latch bolt 10; because the pressing block 12 is disengaging from the lock catch 28 of the wedge 27, under the action of the third spring 11, the wedge 27 moves upwards in the slide block lock base 13, until the slope 24 of the wedge 27 goes beyond the position of the latch bolt 10 to press the latch bolt 10 into the lock slot 8 of the power slide block 6; the latch bolt 10 hinged to the latch bolt hinge base 25 is locked with the lock slot 8 of the power slide block 6 again, so that the power slide block 6 is locked with the first support 14, the piston 2 and the power slide block 6 are all reset; at this time, the water inlet valve is closed, and a working cycle ends.

Embodiment 2

Referring to FIG. 1 and FIG. 2, the present invention provides a hydraulic energy storage mechanism, used to control a suction drainage device of a water closet, and including a piston cylinder and a control section; the present invention use the water pressure of the tap water to push a piston to compress a spring and converted into elastic potential energy; the power slide block is driven by releasing the elastic potential energy to operate the suction drainage device of a water closet.

Specifically, the hydraulic energy storage mechanism includes a piston cylinder 17, and the piston cylinder 17 including a cylinder body 18, a cylinder block 21, and a piston guide cylinder 15; openings are provided on two axial ends of the cylinder body 18, the piston guide cylinder 15 is covered on the opening of one end of the cylinder body 18, and the cylinder block 21 is disposed on the opening of the other end of the cylinder body 18. Certainly, the specific structure of the piston cylinder is not limited thereto, and can be adjusted according to specific conditions.

A water inlet 20 and a water outlet 4 are disposed on the piston cylinder 17, a water inlet valve is disposed on the water inlet 20, and a drainage valve is disposed on the water outlet 4. In this embodiment, the water inlet 20 and the water outlet 4 are disposed on the cylinder block 21. Certainly, the water inlet and the water outlet can also be disposed on other positions of the piston cylinder, and this is not limited herein.

A piston 2 is disposed in the piston cylinder 17, and the piston 2 is coaxially fixed on a piston rod 3. One end of the piston rod 3 is located in the piston cylinder 17, a seal rod 19 is axially disposed in the cylinder body 18, and a first piston rod hole 22 is disposed at the center of the seal rod 19. One end of the seal rod 19 is fixed on the cylinder block 21, and the other end of the piston rod 3 passes through the first piston rod hole 22 of the seal rod 19 and the second piston rod hole 7 of the power slide block 6 to be fixedly connected to the pressing block 12.

The piston 2 is connected to the piston rod 3 through the guiding cylinder 1; Specifically, the guiding cylinder 1 is sleeved on the end part of one end of the piston rod 3 and is fixedly connected, one end of the guiding cylinder 1 and one end of the piston rod 3 stretches into the piston guide cylinder 15, and a first spring 16 is disposed between the guiding cylinder 1 and the piston guide cylinder 15. The first spring 16 is sleeved on the guiding cylinder 1 and the two ends of the first spring 16 respectively abut between the guiding cylinder 1 and the piston guide cylinder 15. The piston 2 is sleeved on an outer side wall of the other end of the guiding cylinder 1 and is fixedly connected, the inner ring of the other end of the guiding cylinder 1 is sleeved on the other end of the seal rod 19; the guiding cylinder 1 can axially move along the outer side wall of the seal rod 19, and the piston rod 3 can axially move along the first piston rod hole 22 of the seal rod 19.

Therefore, synchronous motion between the piston 2 and the guiding cylinder 1 and the piston rod 3 is realized.

When the piston cylinder 17 is filled with water, under the action of the water pressure, the piston 2 is pushed to the top part of the cylinder body 18 and compresses the first spring 16. When water in the piston cylinder 17 is discharged, the water pressure acting on the piston 2 disappears, under the action of the elastic force of the first spring 16, the piston 2 is pushed to move; meanwhile, the guiding cylinder 1 axially moves along the outer side wall of the seal rod 19, and the piston rod 3 axially moves along the inner side wall of the seal rod 19.

In this embodiment, the control section includes a first support 14, a power slide block 6, a pressing block 12, and a locking and unlocking mechanism; the first support 14 is fixed on the piston cylinder, and the power slide block 6 is disposed in the first support 14 and can move along the inner wall of the first support 14; a second piston rod hole 7 is disposed at the center of the power slide block 6, and the other end of the piston rod 3 passes through the piston cylinder 17 and stretches into the first support 14, and passes through the second piston rod hole 7 of the power slide block 6.

At least one spring hole 23 is disposed on the end surface of the power slide block 6 facing a connection end of the first support and the piston cylinder. Preferably, two spring holes 23 can be disposed on the power slide block 6. The two spring holes 23 can be symmetrically disposed about the piston rod 3, and the number of the spring holes 23 is not limited thereto. A second spring 5 is disposed in the spring hole 23; two ends of the second spring 5 are respectively abutted against the bottom of the spring hole 23 and the first support 14.

The other end of the piston rod 3 stretches out of the piston cylinder 17 and stretches into the first support 14, and then passes through the second piston rod hole 7 at the center of the power slide block 6; a pressing block 12 is connected to the end of the piston rod 3, and the pressing block 12 is fixed on the end part of the piston rod 3. The piston rod 3 can axially move relative to the piston cylinder, the first support 14, and the power slide block 6. When the piston rod 3 moves axially upwards, the pressing block 12 is pressed on the end surface of the power slide block 6 to drive the power slide block 6 to move and can compress the second spring 5.

The locking and unlocking mechanism is used to lock the power slide block 6, so that the power slide block 6 is fixed relative to the first support 14.

Further, the locking and unlocking mechanism includes a latch bolt 10 and a wedge 27. An installation through-hole is provided on a side wall of the first support 14, and a latch bolt hinge base 25 is disposed in the installation through-hole. The latch bolt 10 is hinged to the latch bolt hinge base 25 in the installation through-hole, and the latch bolt 10 can stretch out of or draws back from the inner side wall of the first support 14; the outer side wall of the power slide block 6 is disposed with a lock slot 8 matched to the latch bolt 10; and the latch bolt 10 is clamped in the lock slot 8, so that the power slide block 6 is fixed, and the second spring 5 is in a compressed state.

A slide block lock base 13 is formed on a position, corresponding to the installation through-hole, of the outside of the side wall of the first support 14; the wedge 27 is disposed in the slide block lock base 13 and can move along the slide block lock base 13; A spring seat 26 is disposed in the slide block lock base, a third spring 11 is disposed between the wedge 27 and the spring seat 26, and the wedge 27 moves along the slide block lock base 13 to compress the third spring 11.

The slide block lock base 13 is connected with the installation through-hole of the latch bolt 10; one side of the latch bolt 10 in the installation through-hole is abutted against the side wall of the power slide block 6, and the other side is abutted against the side wall of the upper end of the wedge 27, a slope 24 of the side wall of one end of the wedge 27 relative to the one side of the latch bolt 10, and a lock catch 28 stretching into the first support 14 is disposed on the other end of the wedge 27. The piston rod 3 moves downwards; when the pressing block 12 connected to the end part of the piston rod 3 contacts the lock catch 28 and presses the lock catch 28 to drive the wedge 27 to move, and meanwhile, the third spring 11 is compressed. The wedge 27 moves, and the latch bolt 10 slides through the slope 24, the wedge 27 is no longer abuts against the latch bolt 10, so that the latch bolt 10 is departed from the lock slot 8. The power slide block 6 is disengaging from the latch bolt 10. Under the action of the second spring 5, the power slide block 6 slides downwards.

During the moving process of the power slide block 6 in the first support 14, a device for closing the water inlet is disposed on a travel upper limit position of the power slide block 6, and a device for closing the water outlet and a device for opening the water inlet are disposed on a travel lower limit position. That is, when the power slide block 6 moves to the travel upper limit position, the device for closing the water inlet is triggered; when the power slide block 6 moves to the travel lower limit position, the device for closing the water inlet and the device for opening the water inlet are triggered.

As compared with the method of using buoyance to drive the suction drainage device on the water closet in the prior art, the hydraulic energy storage mechanism provided in the present invention drives the piston and compresses the first elastic structure by the water pressure generated during water supplying in the piston cylinder, and the water pressure is converted into elastic potential energy for energy storage. The elastic potential energy is released during drainage to drive the power slide block to move. The movement of the power slide block can be used to operate the suction drainage device. As compared with the buoyancy control mechanism in the prior art, the size of the buoyance tank is not required to be considered for the hydraulic energy storage mechanism. The hydraulic energy storage mechanism in the present invention has advantages of a small volume, large acting force, a simple structure, and reliable working, and effectively improves sewage drainage efficiency of the water closet. The overall structure is more miniature, so as to facilitate expanding application scope.

Embodiment 3

Figure 3:
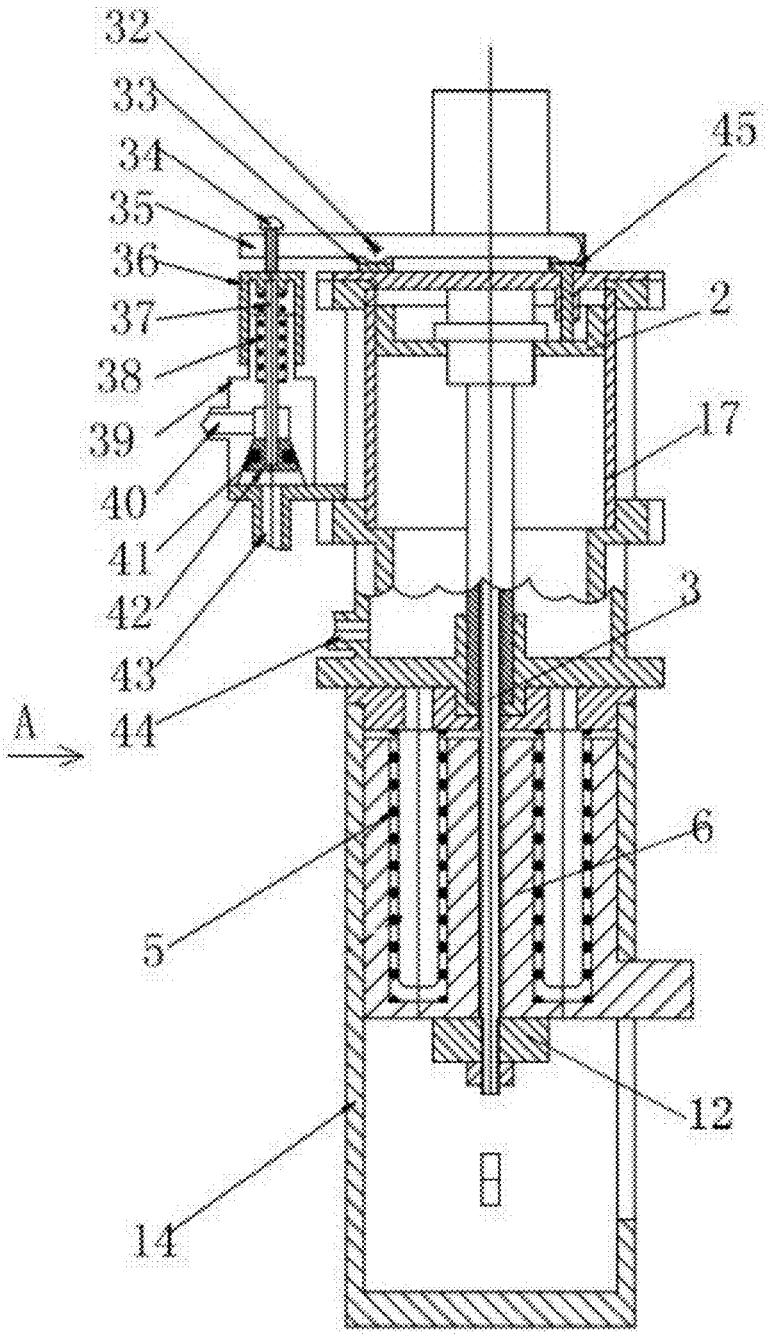
FIG. 3 is a sectional view of a hydraulic energy storage mechanism of embodiment 3 of the present invention.
Figure 4:
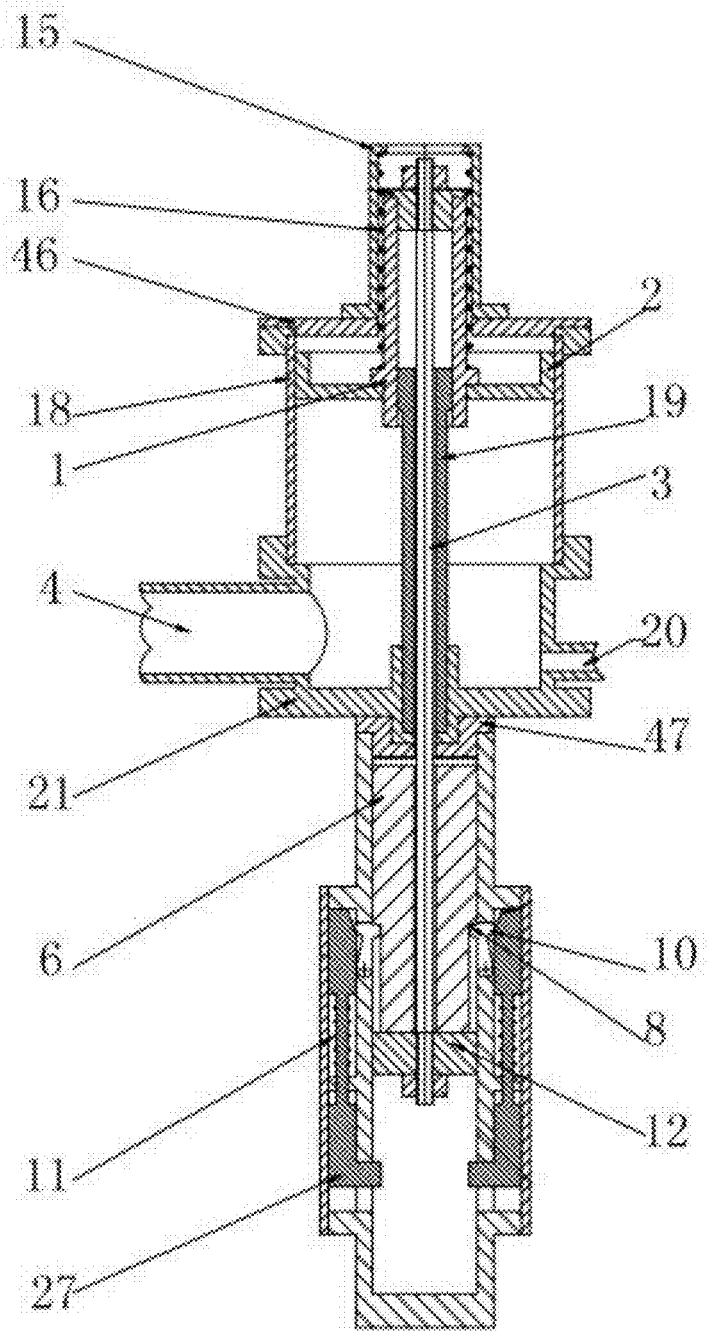
FIG. 4 is a sectional view of FIG. 3 in the direction of A.

This embodiment is amended based on embodiment 1 or embodiment 2, and details are described as follows:

Referring to FIG. 3 and FIG. 4, the hydraulic energy storage mechanism in this embodiment further includes a relief valve; a relief drainage tube 44 is disposed on the piston cylinder 17 (for example, it can be disposed on the side wall of the cylinder block 21 of the piston cylinder 17). The relief valve is disposed on the relief drainage tube 44 and the opening or closing of the relief is controlled by the piston 2 or the component (for example, the piston rod 3 or the pressing block 12, ect) synchronously moving with the piston 2. The specific method used is set according to specific conditions, and is not limited herein.

In this embodiment, preferably, the opening or closing of the relief valve is controlled by using the piston 2.

Further, the relief valve includes a valve seat 39, a valve cover 36, a valve core 42, and a valve core axle 37. A drainage chamber is disposed in the valve seat 39, a water outlet of the relief valve and a water inlet of the relief valve are disposed on the drainage chamber, and the water inlet of the relief valve is connected with a relief water outlet tube 40; a relief valve water inlet tube 43 is connected with the water inlet of the relief valve, and the relief valve water inlet tube 43 is connected with the relief drainage tube 44.

The valve core 42 is disposed at a position of the drainage chamber connected with the relief valve water inlet tube 43, the position of the drainage chamber connected with the relief valve water inlet tube 43 is designed as a taper hole, and the valve core 42 is also designed as a taper valve core. The taper valve core is pressed in the taper hole, and is sealed by using a seal ring 41 on the taper valve core, so as to close the relief valve. One end of the valve core axle 37 stretches into the valve seat 39 and is connected to the valve core 42, and the other end stretches out from the valve seat 39 is connected to the valve cover 36. A fourth spring 38 is disposed between the valve cover 36 and the valve seat 39, and the fourth spring 38 can be implemented in a form of a spring.

After the valve cover 36 being pressed, and the valve cover 36 drives the valve core axle 37 to move downwards and compress the fourth spring 38 at the same time. The valve core axle 37 moves downwards to drive the taper valve core 42 to move downwards, so as to open a channel between the relief valve water inlet tube 43 and the drainage chamber. The relief valve is opened, so that water in the piston cylinder is discharged from the relief drainage tube 44, the relief valve water inlet tube 43, the drainage chamber, and the relief valve water outlet tube 40.

The relief valve is connected to the piston 2 via the triggering mechanism, and the triggering mechanism includes a second support 33, a lever 35, and a bracket 45; the second support 33 is disposed on the top of the outside of the piston cylinder; the lever 35 is disposed on the second support 33 via a support axle 32, and the lever 35 can rotate around the support axle 32. A bracket 45 is connected to one end of the lever 35, and the other end of the lever 35 is connected to the valve cover 36 via an adjustment screw 34 or abuts against the valve cover 36. The lower end of the bracket 45 passes through a cylinder cover 46 of the piston cylinder and stretches into the piston cylinder, and the lower end of the bracket is opposite to the piston 2. When the piston cylinder is almost filled with water, the piston 2 is jacked up to the top of the inside of the piston cylinder, so that the piston 2 contacts with the bracket 45, and jacks up the bracket 45 upwards, the bracket 45 jacks up the lever 35 upwards, and the lever 35 rotates around the support axle 32, so that the other end of the lever 35 presses the valve cover 36 downwards, so as to open the relief valve. When the water inlet valve is closed, after the piston cylinder discharged some water via the relief valve, the piston 2 moves downwards under the action of the first spring 16, and the piston 2 is separated from the bracket 45. The acting force of the piston 2 applied on the bracket 45 disappears. At this time, under the action of the fourth spring 38, the valve cover 36 and the valve core axle 37 are driven to move upwards, so as to close the relief valve; water in the piston cylinder cannot be discharged via the relief valve.

Certainly, the structural form of the triggering mechanism is not limited thereto, and can be adjusted according to specific conditions, which is not limited herein.

The hydraulic energy storage mechanism with a relief device provided in this embodiment has following working principles:

1. The Drainage and Energy Release Process

In an initial condition, the piston cylinder is filled with water, the relief valve, the water inlet valve, and the drainage valve are in a closed state. The piston 2 is located at the upper end inside the piston cylinder, and the piston 2 does not contact with the bracket 45. The first spring 16 and the second spring 5 are in a compressed state, and the power slide block 6 is fixed via the latch bolt 10, that is, the states shown in FIG. 3 and FIG. 4.

When the water closet needs water supplying to drain, the drainage button of the water closet is manually pressed (that is, an opening switch of the drainage valve on the water outlet 4), the drainage valve on the water outlet 4 is opened, and water in the piston cylinder is discharged from the water outlet 4; with the discharging of water in the piston cylinder, the acting force of water on the piston 2 disappears. Under the action of the first spring 16, the piston 2 moves downwards along the inner side wall of the piston cylinder. The piston 2 drives the guiding cylinder 1 to move downwards along the seal rod 19, so as to drive the piston rod 3 to move downwards relative to the seal rod 19, a sleeve cover 47, and the power slide block 6, the piston rod 3 drives the pressing block 12 to move downwards in the first support 14, At this time, the power slide block 6 is in a static state under the action of the latch bolt 10, and the pressing block 12 starts to disengage from the power slide block 6.

When the pressing block 12 moves downwards to contact with a lug of the lower end of the wedge 27 stretching into the first support 14, the pressing block 12 drives the wedge 27 to move downwards, the wedge 27 overcomes the resistance of the third spring 11 to move downwards, until the slope 24 of the wedge 27 reaches the position of the latch bolt 10; at this time, the piston 2, the piston rod 3, the pressing block 12, and the wedge 27 reach the travel limiting positions; the latch bolt 10 hinged to the first support 14 is disengaged from the blocking of the wedge 27 and disengaged from the lock slot 8 of the power slide block 6.

After the power slide block 6 is disengaged from the locking of the latch bolt 10, under the action of the second spring 5, the power slide block 6 slides downwards in the first support 14; Because the device for controlling the opening of the water inlet valve and the device for controlling the closing of the drainage valve are installed on the travel lower limiting positions of the power slide block 6; when the power slide block 6 slides downwards to the travel lower limiting position, the power slide block 6 contacts with the device for controlling the opening of the water inlet valve and the device for controlling the closing of the drainage valve, and closes the drainage valve and opens the water inlet valve, the tap water supplies water to the piston cylinder via the water inlet 20.

2. The Water Supplying and Energy Storage Process

With the opening of the water inlet, the tap water supplying water to the piston cylinder 17 via the water inlet 20, water acting on the surface of the piston 2 applies pressure to the piston 2 to push the piston 2 to move upwards in the piston cylinder 17 and compress the first spring 16. Meanwhile, the piston 2 drives the piston rod 3 to move upwards, and the piston rod 3 drives the pressing block 12 to drive the power slide block 6 to compress the second spring 5 to move upwards in the first support 14.

When the lock slot 8 on the power slide block 6 moves upwards close to the reset position of the latch bolt 10, at this time, the upper end surface of the piston 2 contacts with the bracket 45 and pushes the bracket 45, the bracket 45 holds up one end of the lever 35 to rotate around the support axle 32 so as to force the other end of the lever 35 to be pressed downwards; the pressing end of the lever 35 presses the valve cover 36 downwards via the adjustment screw 34, and compresses the fourth spring 38; the valve cover 36 is pressed downwards, and enables the taper valve core 42 via the valve core axle 37 to move downwards, and gradually opens the relief valve, at this time, the water inlet amount of the piston cylinder is greater than the drainage amount of the relief valve; the piston 2, the piston rod 3, the power slide block 6, and the pressing block 12 continue moving upwards, until the lock slot 8 of the power slide block 6 move upwards to the reset position of the latch bolt 10. Because the pressing block 12 is disengaged from the lug of the lower end of the wedge 27. Under the action of the third spring 11, the wedge 27 moves upwards until the slope 24 of the wedge 27 goes beyond the position of the latch bolt 10 and presses the latch bolt 10 into the lock slot 8 of the power slide block 6, so that the power slide block 6 is locked with the first support 14.

The power slide block 6 is locked with the first support 14, at this time, the power slide block 6 is on the travel upper limit position, and triggers the device for controlling the closing of the water inlet valve, and the water inlet valve automatically closes; at this time, because the relief valve is opened, some water in the piston cylinder is discharged through the relief drainage tube 44 and the relief valve water inlet tube 43, and enters the drainage chamber relief valve, and is discharged via the relief valve water outlet tube 40, under the action of the first spring 16, the piston 2 starts to push the piston 2, the piston rod 3, and the pressing block 12 to move downwards, so that the pressing block 12 is disengaged from the power slide block 6 without being under the action of the second spring 5, at this time, the pressure in the piston cylinder 17 is only the action of the first spring 16, until the piston 2 moves downwards to disengage from the bracket 45, under the action of the fourth spring 38, the relief valve is closed, all reset, and a working cycle ends.

The technical effects generated by using the foregoing technical solutions of this embodiment are further described in the following.

In the present invention, a relief valve is further disposed on the hydraulic energy storage mechanism. Because the drainage valve on the drainage is connected with the piston cylinder, when the water pressure of the tap water pushes the piston 2, the second spring 5 and the first spring 16 are compressed, when the water inlet valve is closed, under the action of the second spring 5 and the first spring 16, the pressure in the piston cylinder 17 is great, so that the drainage valve cannot be easily opened, and the water closet cannot be normally used. The action of the relief valve is that: when the water inlet valve is closed, the power slide block 6 is locked with the first support 14, and the second spring 5 does not act, under the action of the first spring 16, the piston 2 is pushed to move downwards, so as to enable the pressing block 12 to disengage from the power slide block 6, the piston rod 3 is not acted by the second spring 5, and the piston 2 is not acted by the second spring 5, so as to reduce pressure in the piston cylinder chamber, and easily open the drainage valve. The operations are more quick and convenient.

Embodiment 4

The present invention further provides a water closet, using the hydraulic energy storage mechanism which is said in embodiment 1, embodiment 2, or embodiment 3, the hydraulic energy storage mechanism is used to open or close a suction drainage device of the water closet.

A person skilled in the art should understand that the present invention can be implemented in many other specific forms without departing from the spirit or scope of the present invention. Although the embodiments of the present invention are described, it should be understood that the application of the present invention should not be limited to these embodiments, and a person skilled in the art can make changes and modifications within the spirit and scope of the present invention as defined in the claims attached.

The invention claimed is:

1. A hydraulic energy storage mechanism, wherein the hydraulic energy storage mechanism comprises:

a cylinder block provided with a water inlet and a water outlet, and axially provided with a seal rod, the axle center of the seal rod is provided with a first piston rod hole;

a piston cylinder axially provided with a cylinder body and a piston guide cylinder, and axially connected to one end of the cylinder block;

a piston provided with a piston rod, one end of the piston being provided with a pressing block and the other end being provided with a guiding cylinder, and the piston being provided in the piston cylinder;

a first support provided with a power slide block and a slide block lock base, and axially connected to the other end of the cylinder block, the slide block lock base is provided thereon with a latch bolt hinge base and a spring seat, the power slide block being provided thereon with a spring hole, a lock slot, and a second piston rod hole; and a latch bolt component provided in the slide block lock base of the support.

2. The hydraulic energy storage mechanism according to claim 1, wherein the latch bolt component including a latch bolt, a wedge, and a third spring; the wedge is a strip body with a slope provided on one end and a lock catch provided on the other end; the latch bolt is hinged on the latch bolt hinge base of the slide block lock base, the wedge is provided in the slide block lock base, and the third spring is provided between the wedge and the spring seat of the slide block lock base.

3. The hydraulic energy storage mechanism according to claim 1, wherein the other end of the piston rod provided with the pressing block on the piston passes through the first piston rod hole of the seal rod and the second piston rod hole of the power slide block, and the end provided with the guiding cylinder is sleeved to the seal rod of the cylinder block.

4. The hydraulic energy storage mechanism according to claim 1, wherein a first spring is provided between the guiding cylinder of the piston and the piston guide cylinder of the piston cylinder.

5. The hydraulic energy storage mechanism according to claim 1, wherein a second spring is provided between one end surface of the first piston rod hole of the cylinder block and the spring hole of the power slide block.

6. A hydraulic energy storage mechanism, comprising a hydraulic energy storage mechanism of claim 1, and a relief valve, wherein a relief water outlet is further disposed on the piston cylinder, and the relief valve is disposed on the relief water outlet; opening or closing of the relief valve is implemented through triggering by the piston or a part synchronously moving with the piston;

during a water supplying process of the piston cylinder, the power slide block moves upwards; before being locked, the piston or the part synchronously moving with the piston triggers to open the relief valve; the power slide block continues moving upwards, moves to a travel upper limit position of the power slide block, and triggers a device which is disposed on the travel upper limit position of the power slide block and used for closing a water inlet, so as to stop supplying water; some water in the piston cylinder is discharged through a relief drainage tube, and the power slide block is locked at this time; a first spring continues pushing the piston, the piston rod, and the pressing block to separate from the power slide block; meanwhile, the relief valve is gradually reset to closed, and the piston, the piston rod, and the pressing block stop moving downwards;

during a drainage process of the piston cylinder, the first spring pushes the piston and the piston rod to move downwards; the piston rod moves downwards to a travel lower limit position of the piston rod and triggers the latch bolt component to unlock the power slide block; under an action of a second spring, the power slide block moves downwards to the travel lower limit position to trigger a device which is disposed on the travel lower limit position of the power slide block and used for closing the water outlet, and a device for opening the water inlet.

7. The hydraulic energy storage mechanism with a relief device according to claim 6, wherein the piston controls the relief valve to open and close by using a triggering mechanism; the triggering mechanism comprises a second support, a lever, and a bracket; the second support is fixed on the top of the outside of the piston cylinder; the lever rotatably installed on the second support through a support axle; one end of the lever is connected to the bracket, a lower end of the bracket stretches into the piston cylinder, and the other end of the lever is connected to the relief valve; the piston moves upwards to contact the bracket and jacks up the bracket; the lever rotates, and the other end of the lever is pressed downwards to open the relief valve.

8. The hydraulic energy storage mechanism with a relief device according to claim 7, wherein the relief valve comprises:

a valve seat, wherein a drainage chamber is disposed in the valve seat, a water outlet of the relief valve and a water inlet of the relief valve are disposed on the drainage chamber, and the water inlet of the relief valve is connected with the relief water outlet;

a valve core is blocked at a position of the drainage chamber connected with the water inlet of the relief valve;

a valve core axle, the lower end of which stretching into the valve seat and being connected to the valve core; and a valve cover fixedly connected to an upper end of the valve core axle, wherein a fourth spring is provided between the valve cover and the valve seat; and the valve cover is further connected to the other end of the lever by using an adjustment screw.

9. A water closet, wherein the hydraulic energy storage mechanism in claim 1 is used, and the hydraulic energy storage mechanism is used for opening or closing a suction drainage device of the water closet.

10. A hydraulic energy storage mechanism, comprising a piston cylinder and a control device, wherein the piston cylinder is provided thereon with a water inlet and a water outlet; the piston cylinder is provided therein with a piston connected to a piston rod; a first spring is provided between the piston or a part synchronously moving with the piston and the piston cylinder;

the control device comprises a first support, a power slide block, and a locking and unlocking mechanism, and the first support is connected to the piston cylinder; the power slide block is disposed in the first support, and a second spring is provided between the power slide block and the first support; the power slide block move along the support; a device for closing the water inlet is disposed on a travel upper limit position of the power slide block, and a device for opening the water inlet and a device for closing the water outlet are disposed on a travel lower limit position; one end of the piston rod movably pass through the piston cylinder, the support, and the power slide block, and then is connected to a pressing block; the locking and unlocking mechanism is used for locking and unlocking between the power slide block and the first support;

the piston cylinder drains away water; the first spring pushes the piston and the piston rod to move downwards; the piston rod moves downwards to the travel lower limit position of the piston rod and triggers the locking and unlocking mechanism to implement unlocking between the power slide block and the first support; under the action of the second spring, the power slide block moves downwards to the travel lower limit position to trigger the device disposed on the travel lower limit position of the power slide block and used for closing the water outlet and the device for opening the water inlet; the piston cylinder is supplied with water; the piston drives the piston rod to move upwards and compresses the first spring; the piston rod drives, by means of the pressing block, the power slide block to move upwards and compress the second spring; the power slide block moves upwards to the travel upper limit position, triggers the device provided for closing the water inlet, and stops supplying water; at this time, the power slide block and the first support are in a locking state.

11. The hydraulic energy storage mechanism according to claim 10, wherein the piston cylinder including a cylinder body, a piston guide cylinder, and a cylinder block; two axial ends of the cylinder body are respectively connected to the piston guide cylinder and the cylinder block; the piston is disposed in the cylinder body, and an upper end of the piston rod stretches into the piston guide cylinder; the cylinder block is connected with the cylinder body, the water inlet and the water outlet are disposed on the cylinder block, the cylinder block is connected to the first support.

12. The hydraulic energy storage mechanism according to claim 11, wherein a seal rod and a guiding cylinder are axially disposed in the piston cylinder, a first piston rod hole is disposed at the center of the seal rod, the seal rod is axially fixed in the piston cylinder, and one end of the piston rod passes through the first piston rod hole of the seal rod; the guiding cylinder is fixedly sleeved on one end of the piston rod and stretches into the piston guide cylinder together; the first spring is sleeved on the guiding cylinder, and the upper end of the first spring abuts against the top of the piston guide cylinder; one end of the guiding cylinder is fixedly connected to the piston rod, and the other end is sleeved on the seal rod; the guiding cylinder and the piston rod axially move relative to the seal rod; the piston is fixedly sleeved on the guiding cylinder.

13. The hydraulic energy storage mechanism according to claim 10, wherein one end of the first support is axially connected to one end of the piston cylinder; the power slide block is disposed in the first support; one end surface of the power slide block facing the piston cylinder is disposed with a spring hole; one end of the second spring is disposed in the spring hole, and the other end abuts against an end part of the first support.

14. The hydraulic energy storage mechanism according to claim 10, wherein the locking and unlocking mechanism comprises:

a latch bolt, wherein a side wall of the first support is provided thereon with an installation through-hole, a latch bolt hinge base is disposed in the installation through-hole, the latch bolt is hinged on the latch bolt hinge base in the installation through-hole; an outer side wall of the power slide block is disposed with a lock slot matched to the latch bolt; and a wedge, wherein a slide block lock base is formed on a position, corresponding to the installation through-hole, of the outside of the side wall of the first support; the wedge is disposed in the slide block lock base and moves along the slide block lock base; a spring seat is disposed in the slide block lock base, a third spring is disposed between the wedge and the spring seat; a slope is disposed on a surface of one end of the wedge opposite to the latch bolt, and a lock catch stretching into the first support is disposed on the other end;

the slope end on the upper end of the wedge abuts against the latch bolt, so that the latch bolt is clamped into the lock slot for locking; the pressing block moves to the lock catch to push the lock catch so as to enable the wedge to move, and the wedge moves to enable the latch bolt to move along the slope, so that the latch bolt is departed from the lock slot for unlocking.

* * * * *